US011952862B2

(12) United States Patent
Fripp et al.

(10) Patent No.: US 11,952,862 B2
(45) Date of Patent: Apr. 9, 2024

(54) WIRELESS FLOW CONTROL DEVICES AND METHODS TO REESTABLISH FLUID FLOW THROUGH A FLOW CONTROL DEVICE

(71) Applicant: Halliburton Energy Services, Inc., Houston, TX (US)

(72) Inventors: Michael Linley Fripp, Singapore (SG); Stephen Michael Greci, Carrollton, TX (US); Ibrahim El Mallawany, Al-Khobar (SA)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

(21) Appl. No.: 17/745,856

(22) Filed: May 16, 2022

(65) Prior Publication Data

US 2023/0366291 A1 Nov. 16, 2023

(51) Int. Cl.
*E21B 34/06* (2006.01)
*E21B 41/00* (2006.01)

(52) U.S. Cl.
CPC ..... *E21B 34/066* (2013.01); *E21B 34/063* (2013.01); *E21B 41/0085* (2013.01)

(58) Field of Classification Search
CPC .. E21B 34/06; E21B 2200/06; E21B 41/0085; E21B 34/066; E21B 34/063
See application file for complete search history.

(56) References Cited

U.S. PATENT DOCUMENTS 10,619,435 B2 4/2020 Greci et al.
10,626,702 B2 4/2020 Ornelaz et al.
11,066,904 B2 7/2021 Fripp et al.
2012/0067567 A1* 3/2012 Rytlewski ..... E21B 41/0085 166/250.01
2014/0338922 A1 11/2014 Lopez et al.
2015/0090444 A1* 4/2015 Partouche ..... E21B 41/0085 166/254.2
2016/0115782 A1 4/2016 Martinez
2017/0306725 A1* 10/2017 Hunter ..... E21B 41/0085
2018/0283134 A1 10/2018 Ornelaz et al.
2019/0234179 A1* 8/2019 Walton ..... E21B 34/14
2019/0316445 A1* 10/2019 Fripp ..... E21B 41/0085
2019/0345802 A1 11/2019 Shields
2020/0040676 A1* 2/2020 Greci ..... E21B 21/08

FOREIGN PATENT DOCUMENTS

WO 2018104778 A1 6/2018

OTHER PUBLICATIONS

International Search Report and Written Opinion dated Feb. 14, 2023; International Application No. PCT/US2022/030597.

* cited by examiner

*Primary Examiner* — Brad Harcourt
(74) *Attorney, Agent, or Firm* — Barnes & Thornburg LLP

(57) ABSTRACT

A wireless flow control device includes a shiftable apparatus and a power source configured to provide power to shift the shiftable apparatus from a first position to a second position. The wireless flow control device also includes a valve that forms a first fluid flow path through the wireless flow control device while the shiftable apparatus is in the first position. The wireless flow control device further includes an actuation assembly, which, when actuated, forms a second fluid flow path through the wireless flow control device, and a turbine configured to recharge the power source.

18 Claims, 10 Drawing Sheets

WIRELESS FLOW CONTROL DEVICES AND METHODS TO REESTABLISH FLUID FLOW THROUGH A FLOW CONTROL DEVICE

BACKGROUND

The present disclosure relates generally to wireless flow control devices and methods to reestablish fluid flow through a flow control device.

Fluids are sometimes pumped through one or more ports of a tubular into a wellbore during certain well operations, such as hydraulic fracturing operations, well injection operations, and production operations. Flow control devices are sometimes positioned at certain sections of the tubular to control fluid flow into and out of the tubular. Some fluid flow control devices have shiftable apparatuses that are configured to shift to multiple positions to control fluid flow through the flow control devices.

BRIEF DESCRIPTION OF THE DRAWINGS

Illustrative embodiments of the present disclosure are described in detail below with reference to the attached drawing figures, which are incorporated by reference herein, and wherein.

Figure 1:
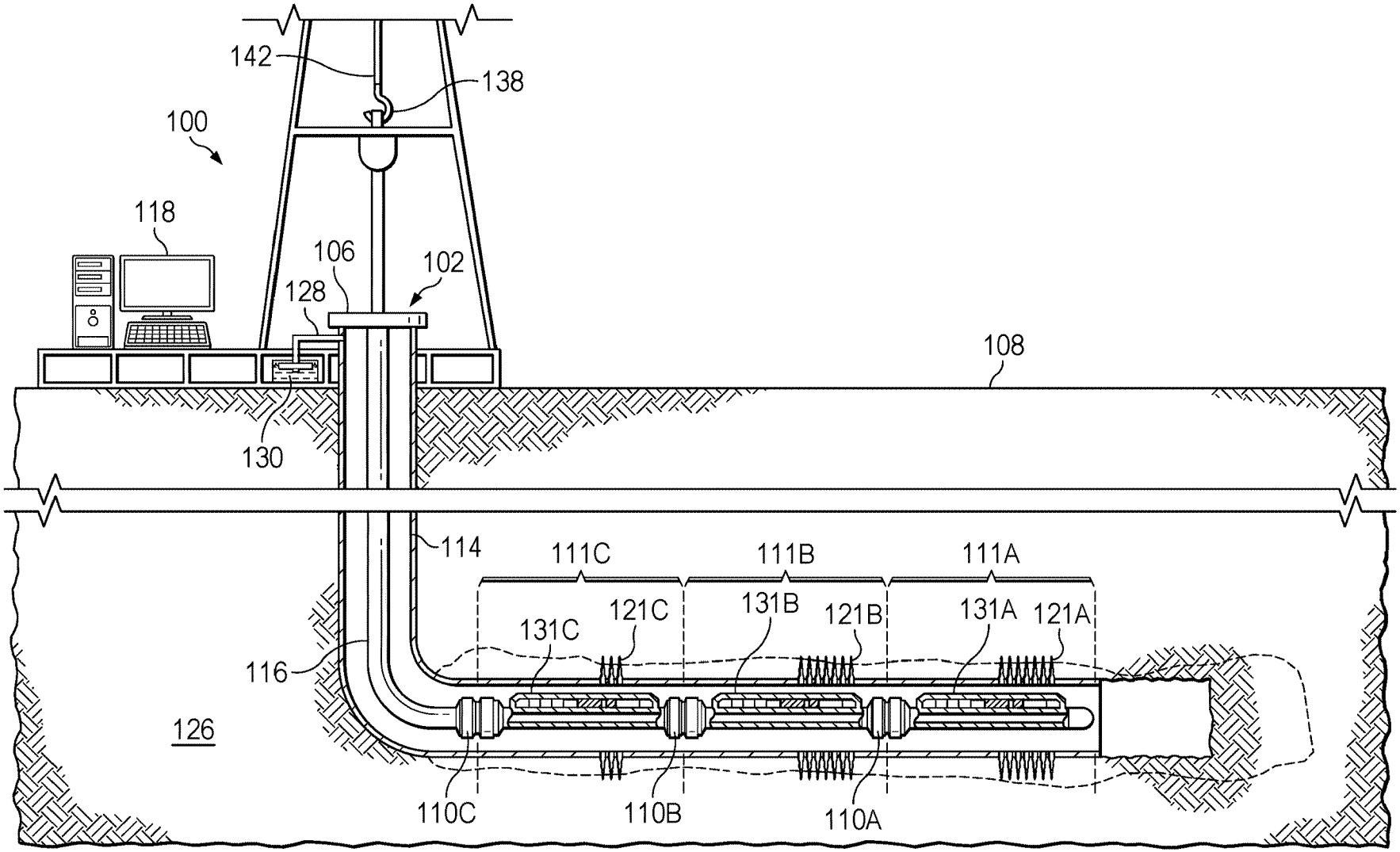
FIG. 1 is a schematic, side view of a well environment having three wireless flow control devices deployed in a well.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to wireless flow control devices and methods to reestablish fluid flow through a flow control device. A wireless flow control device has a shiftable apparatus that is configured to shift to one or more positions along the wireless flow control device to control fluid flow through the wireless flow control device. More particularly, a valve of the wireless flow control device forms a fluid flow path (first fluid flow path) through the wireless flow control device while the shiftable apparatus is in an initial position (first position). As referred to herein, a shiftable apparatus includes any component, device, or apparatus that is shiftable to one or more positions along the wireless flow control device. Examples of shiftable apparatuses include, but are not limited to, sleeves, covers, rods, pistons, latches, and other types of components, devices, or apparatuses configured to shift to one or more positions along the wireless flow control device. In some embodiments, the shiftable apparatus is a shiftable sleeve having a shape that is similar to the shape of the shiftable sleeve illustrated in FIGS. 2A-2C. In some embodiments, the shiftable apparatus is a concentric sleeve that is concentric about the axis of the tubing. In one or more of such embodiments, the concentric sleeve spans 360 degrees. In one or more of such embodiments, the concentric sleeve covers an arc that is less than 360 degrees. In some embodiments, the shiftable apparatus is a piston sleeve configured to variably restrict fluid flow from the outside diameter and inside diameter of the tubing. In one or more of such embodiments, the piston sleeve is cylindrical shaped, conical shaped, prismatic shaped, or has the shape of another translatable object. In some embodiments, the shiftable apparatus is an actuation sleeve, where the actuation sleeve is utilized to adjust a degree of restriction of a control valve, such as a ball valve, diaphragm valve, or flapper valve. In some embodiments, the shiftable apparatus is a spool valve. In some embodiments, where the wireless flow control device is fluidly coupled to a tubular, the first fluid flow path provides a flow path for fluids to flow into and/or out of the tubular. However, after the shiftable apparatus is shifted from the first position to another position (second position), the shiftable apparatus severs or prevents fluids from flowing through the first fluid flow path while the shiftable apparatus is in the second position.

The shiftable apparatus is powered by a power source that is configured to supply power to the shiftable apparatus to shift the shiftable apparatus, such as from the first position of the shiftable apparatus to the second position of the shiftable apparatus to prevent fluid flow through the wireless flow control device, from the second position of the shiftable apparatus to the first position of the shiftable apparatus to permit fluid flow through the wireless flow control device via the first fluid flow path, or to other positions along the wireless flow control device. In some embodiments, the shiftable apparatus is controlled by a downhole or surface-based processor to shift to a desired location along the wireless flow control device. For example, the processor initially requests the shiftable apparatus to maintain the second position during downhole deployment to prevent fluid flow into the wireless flow control device during deployment. The processor subsequently requests the shiftable apparatus to shift from the second position to the first position during a production operation to provide fluid flow into the wireless flow control device during the production operation. The processor subsequently requests the shiftable apparatus to shift from the first position back to the second position after the production operation is completed.

The shiftable apparatus also includes a turbine that is configured to rotate while fluid flows around the turbine (such as via the first fluid flow path) to recharge the power source, which supplies power to shift the shiftable apparatus to shift to a desired location along the wireless flow control device while the power source has more than a threshold amount of stored charge. After fluid flow around the turbine ceases, the turbine no longer recharges the power source, and power stored by the power source is drained to below the threshold level to shift the shiftable apparatus.

The shiftable apparatus has an actuation assembly, which, when actuated, forms a second fluid flow path through the wireless flow control device. As referred to herein, an actuation assembly includes one or more components or devices, which, when actuated, forms a second fluid flow path through the wireless flow control device. In some embodiments, the actuation assembly includes a rupture disk that initially prevents fluid flow through the rupture disk, a thruster, which, when actuated, shifts the thruster from a first position to a second position to rupture the rupture disk, and an actuator, which, when actuated or engaged, shifts or causes the rupture disk to shift from the first position to the second position to rupture the rupture disk. In one or more of such embodiments, the actuation assembly includes or is in communication with a communication module that is configured to receive an actuation signal (such as from a surface-based device or from another downhole device) to actuate the actuation assembly. Moreover, the actuation assembly, in response to receiving the actuation signal, actuates or engages the actuator to shift the thruster to rupture the rupture disk. In one or more of such embodiments, the actuator includes a chemical charge, which, when set off, initiates a chemical reaction that shifts the thruster to rupture the rupture disk. In one or more of such embodiments, the actuator is battery powered, where the battery provides electrical energy to shift the thruster to rupture the rupture disk.

In some embodiments, the actuation assembly is fluidly coupled to or includes a valve (second valve), where fluid flow through via the second valve is initially blocked by the rupture disk while the rupture disk is intact. After the rupture disk is ruptured, a second fluid flow path for fluids to flow through the wireless flow control device via the second valve and through the rupture disk is formed. The second fluid flow path also directly or indirectly provides fluid flow to rotate the turbine, which, in turn, provides power to recharge the power source. Moreover, after the power source is recharged to above the threshold power level, the shiftable apparatus is operable to shift to a desired location to reestablish the first fluid flow path while maintaining fluid flow through the second fluid flow path, reestablish the first fluid flow path and sever the second fluid flow path, or sever both the first and the second fluid flow path.

In some embodiments, the wireless flow control device includes additional actuation assemblies, each of which, when actuated, establishes a new fluid flow path through the wireless flow control device. For example, the wireless flow control device includes a second actuation assembly similar to the actuation assembly described herein. The second actuation assembly, when actuated, provides a third fluid flow path through (e.g., through a third valve). After the third fluid flow path is established, fluid flowing through the third flow path rotates the turbine, which, in turn, recharges the power source. In some embodiments, the wireless flow control device includes a second turbine that is positioned along the second fluid flow path while the first turbine is positioned along the first fluid flow path. In one or more of such embodiments, the first turbine rotates to recharge the power source while the shiftable apparatus is in the first position, and the second turbine rotates to recharge the power source after the second fluid flow path is formed.

In some embodiments, actuating the actuation assembly of the wireless flow control device does not establish a second fluid flow path through the wireless flow control device. In one or more of such embodiments, actuation of the actuation assembly sets off a chemical charge, which rotates the turbine, which, in turn, recharges the power source to above the threshold power level to shift the shiftable apparatus from the second position back to the first position to reestablish the first fluid flow path. In one or more of such embodiments, actuation of the actuation assembly sets off a chemical charge, which shifts the shiftable apparatus from the second position back to the first position, thereby reestablishing the first fluid flow path. Additional descriptions of wireless flow control devices and methods to reestablish fluid flow through a flow control device are provided in the paragraphs below and are illustrated in FIGS. 1-8.

Turning now to the figures, FIG. 1 is a schematic, side view of a well environment 100 having three wireless flow control devices 131A-131C deployed in a well 102. As shown in FIG. 1, a wellbore 114 of well 102 extends from surface 108 of well 102 to or through formation 126. A hook 138, a cable 142, traveling block (not shown), and hoist (not shown) are provided to lower tubular 116 down wellbore 114. Tubular 116 is coupled to or includes three wireless flow control devices 131A-131C that control fluid flow of fluids (such as hydrocarbon resources and reservoir fluids) to flow from formation 126 through fractures 121A-121C into tubular 116, and via tubular 116 back toward surface 108. To that end, a diverter or an outlet conduit 128 may be connected to a container 130 at the wellhead 106 to provide a fluid return flow path from wellbore 114.

In the embodiment of FIG. 1, tubular 116 extends through three zones 111A, 111B, and 111C. Packer assemblies 110A-110C, filters (not shown), sensors (not shown), and other hardware components (not shown), are also run downhole with tubular 116, and are deployed or activated to isolate zones 111A, 111B, and 111C, and control fluid flow into and out of zones 111A, 111B, and 111C. Each of wireless flow control devices 131A-131C includes a shiftable sleeve, a power source that provides power to shift the shiftable sleeve, and a turbine configured to recharge the power source. Illustrations of shiftable sleeves, power sources, and turbines are provided in FIGS. 2A-6. Wireless flow control devices 131A-131C periodically receive instructions from an electronic device, such as controller 118, to regulate and control fluid flow through the respective wireless flow control device 131A, 131B, or 131C. More particularly, controller 118 periodically requests the shiftable sleeves of wireless flow control devices 131A-131C to shift to different positions along wireless flow control devices 131A-131C to control fluid flow through wireless flow control devices 131A-131C into tubular 116.

After certain well operations, controller 118 provides instructions to restrict fluid flow through one or more of wireless flow control devices 131A-131C. For example, controller 118, in response to receiving an instruction to stop fluid flow into zone 111A, requests wireless flow control device 131A (or a communication module of wireless flow control device 131A) to shift the shiftable sleeve of wireless flow control device 131A from a first position to a second position to stop fluid flow into tubular 116 at zone 111A. The turbine of wireless flow control device 131A eventually stops rotating due to a lack of fluid flow through wireless flow control device 131A, and no longer recharges the power source of wireless flow control device 131A. The power source, in turn, drains until the power source no longer stores a threshold amount of power to shift the shiftable sleeve. In the embodiment of FIG. 1, wireless flow control device 131A includes an actuation assembly, which, when actuated, provides an additional fluid flow path to restart the turbine. Continuing with the foregoing example, after the shiftable sleeve has shifted to a position that prevents fluid flow through wireless flow control device 131A, controller 118 transmits an actuation signal to the communication module of wireless flow control device 131A to reestablish fluid flow to the turbine. In some embodiments, wireless flow control device 131A, in response to receiving the actuation signal, initiates a chemical reaction that shifts a thruster to rupture a rupture disk to establish fluid flow to the turbine to rotate the turbine, which, in turn, recharges the power source to above the threshold power level to shift the shiftable sleeve. After the power source is recharged to above the threshold level, controller 118 transmits a signal to shift the shiftable sleeve of wireless flow control device 131A to a different position to provide fluid flow into tubular 116.

Although FIG. 1 illustrates three wireless flow control devices 131A-131C, disposed in three zones, 111A, 111B, and 111C, respectively, in some embodiments, a different number of wireless flow control devices are deployed in a different number of zones. Further, although FIG. 1 illustrates a production environment, wireless flow control devices 131A-131C and similar wireless flow control devices described herein are utilized before, during, and after injection operations, fracking operations, and other well operations. Additional descriptions and illustrations of similar wireless flow control devices, and components of the wireless flow control devices are provided herein, and are illustrated in at least FIGS. 2A-7.

Figure 2A:
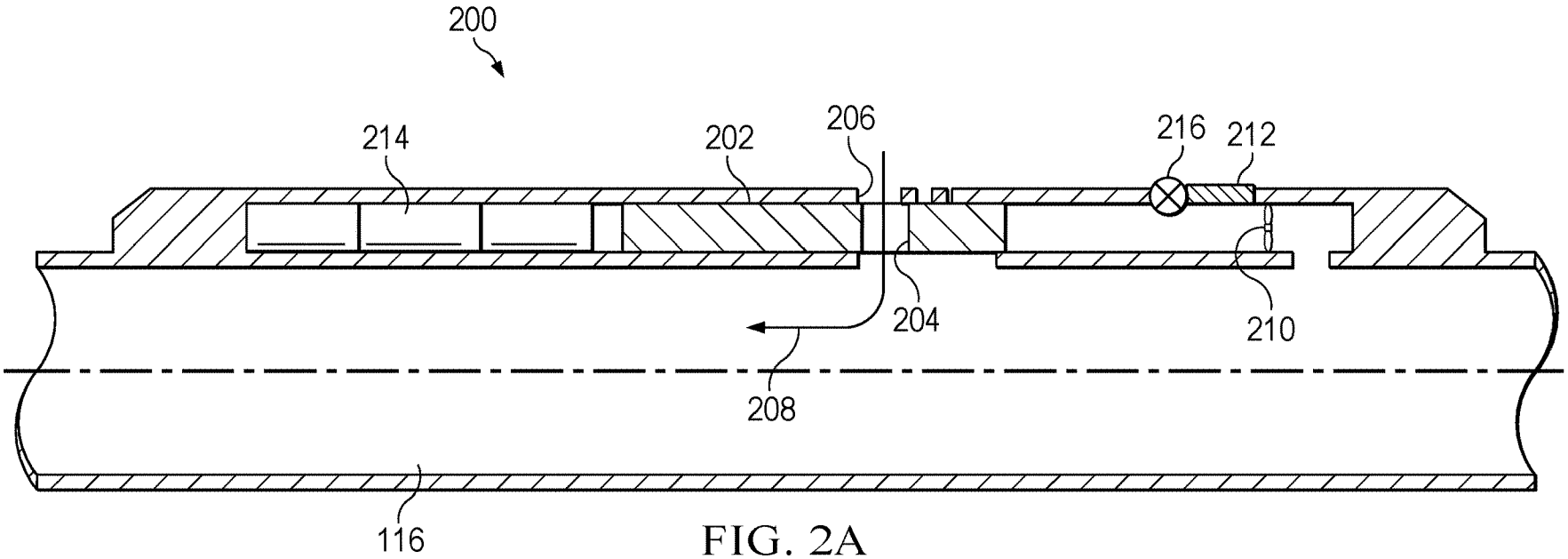
FIG. 2A is a schematic, cross-sectional view of a wireless flow control device that is deployable in the well of FIG. 1 while a shiftable sleeve of the wireless flow control device is in a first position.

FIG. 2A is a schematic, cross-sectional view of a wireless flow control device 200 that is deployable in the well of FIG. 1 while a shiftable sleeve 202 of the wireless flow control device 200 is in a first position. In the embodiment of FIG. 2A, a power source 214 of wireless flow control device 200 provides power to shift shiftable sleeve 202 while power source 214 stores more than a threshold amount of power. In the embodiment of FIG. 2A, and while shiftable sleeve 202 is in the first position, a first fluid flow path in a direction illustrated by arrow 208 is established through a first valve 206 of wireless flow control device 200 and an opening 204 of shiftable sleeve 202, and into a flowbore of tubular 116 of FIG. 1. Further, while shiftable sleeve 202 is in the first position, fluids also flow to a turbine 210 of wireless flow control device 200, which rotates turbine 210. Turbine 210 charges power source 214 to maintain the power source above the threshold amount of power. Wireless flow control device 200 also includes an actuation assembly 212 and a second valve 216. In the embodiment of FIG. 2A, actuation assembly 212 initially prevents fluid flow from second valve 216 through wireless flow control device 200 and into the flowbore of tubular 116 before actuation assembly 212 is actuated. Additional descriptions of actuation assembly are provided herein and are illustrated in at least FIG. 3.

Figure 2B:
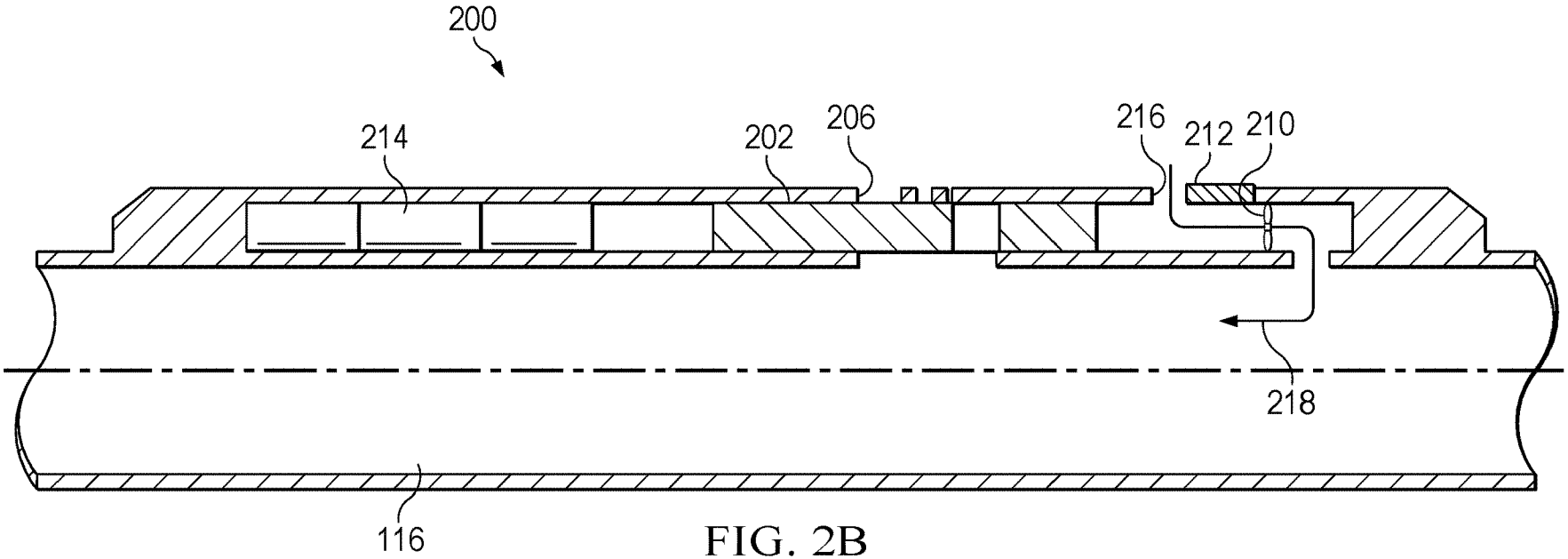
FIG. 2B is a schematic, cross-sectional view of the wireless flow control device of FIG. 2A after the shiftable sleeve shifts from the first position illustrated in FIG. 2A to a second position.

Wireless flow control device 200 periodically receives instructions, such as from controller 118 of FIG. 1, to shift shiftable sleeve 202 to a different position to restrict fluid flow into the flowbore of tubular 116. In that regard, FIG. 2B is a schematic, cross-sectional view of wireless flow control device 200 of FIG. 2A after shiftable sleeve 202 shifts from the first position illustrated in FIG. 2A to a second position illustrated in FIG. 2B. As illustrated in FIG. 2B, the first fluid flow path through wireless flow control device 200 into the flowbore of tubular 116 is severed by shiftable sleeve 202 after shiftable sleeve 202 shifts to the second position illustrated in FIG. 2B. The severing of the first fluid flow path also prevents fluids from flowing to turbine 210 via the first fluid flow path to rotate turbine 210. Power source 214 is eventually depleted while shiftable sleeve 202 remains in the second position illustrated in FIG. 2B and turbine 210 is not rotated.

In the embodiment of FIG. 2B, actuation assembly 212 is actuated to form a second fluid flow path as illustrated by arrow 218, through second valve 216 and actuation assembly 212, to turbine 210 and eventually into the flowbore of tubular 116. In the embodiment of FIG. 2B, although the first fluid flow path is severed by shiftable sleeve 202, fluid flow along the second fluid flow path rotates turbine 210, which, in turn, recharges power source 214 to above a threshold amount of power to shift shiftable sleeve 202. In that regard, the actuation of actuation assembly 212 permits wireless flow control device 200 to provide fluid flow into the flowbore of tubular 116 after fluid flow into the flowbore is initially severed and after a power source, such as power source 214, which provides power to shift shiftable sleeve 202 to reestablish fluid flow into the flowbore, no longer stores sufficient power to shift shiftable sleeve 202. More particularly, actuation of actuation assembly 212 recharges power source 214 to shift shiftable sleeve 202, such as from the second position illustrated in FIG. 2B back to the first position as illustrated in FIG. 2A, to a third position as illustrated in FIG. 2C to permanently restrict fluid flow through wireless flow control device 200, or to a different position along wireless flow control device 200.

Figure 2C:
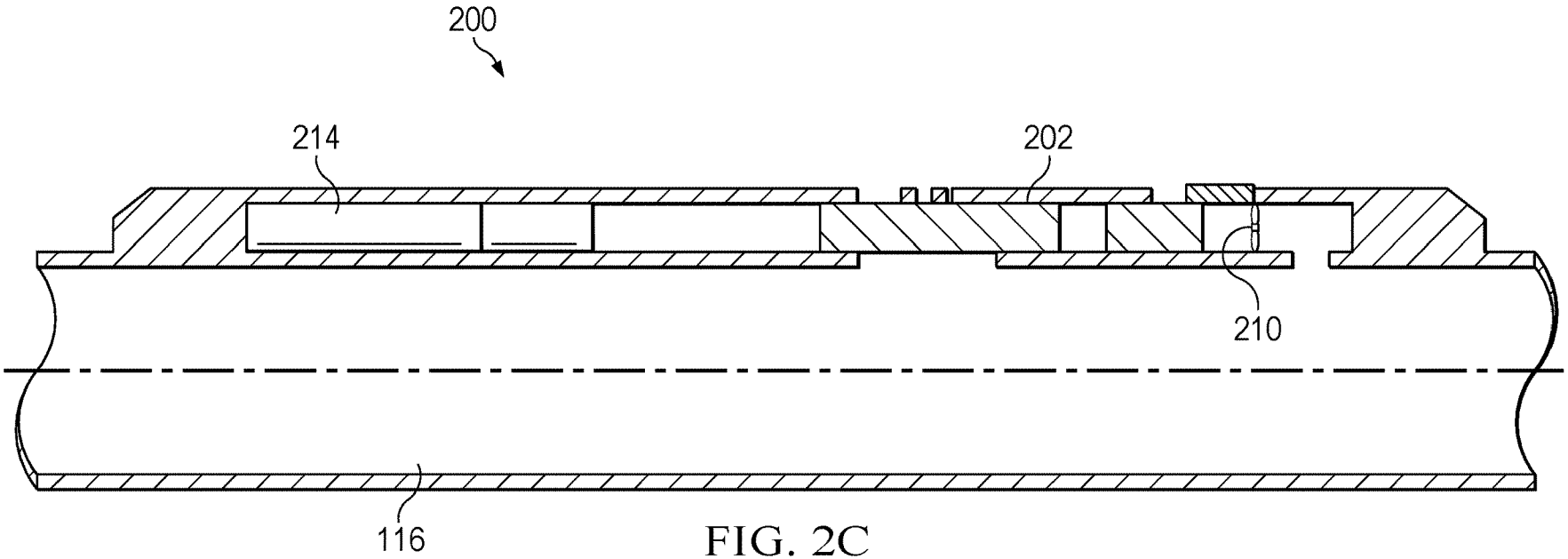
FIG. 2C is a schematic, cross-sectional view of the wireless flow control device of FIG. 2B after the shiftable sleeve shifts from the second position illustrated in FIG. 2B to a third position.

In that regard, FIG. 2C is a schematic, cross-sectional view of wireless flow control device 200 of FIG. 2B after shiftable sleeve 202 shifts from the second position illustrated in FIG. 2B to a third position illustrated in FIG. 2C, where fluid flow through the first fluid flow path and the second fluid flow path are severed by shiftable sleeve 202. In the embodiment of FIG. 2C, fluid no longer flows around turbine 210 to rotate turbine 210. Further, power source 214 eventually drains until power source 214 no longer stores the threshold amount of power to shift shiftable sleeve 202. In the illustrated embodiment, shiftable sleeve 202 is shifted to the third position if it is no longer desired to flow fluid through wireless flow control device 200 into the flowbore of tubular 116.

Although FIGS. 2A-2C illustrate a shiftable sleeve 202, in some embodiments, wireless flow control device 200 utilizes another type of shiftable apparatus, such as but not limited to, a shiftable piston, a shiftable cover, a shiftable rod, a concentric sleeve, a piston sleeve, an actuation sleeve, or another type of shiftable apparatus having an opening similar to opening 204, and shiftable to the positions illustrated in FIGS. 2A-2C. Further, although FIGS. 2A-2C illustrate power source 214 and turbine 210 being separated by shiftable sleeve 202, in some embodiments, power source 214 and turbine 210 are stored in the same housing. Further, although FIGS. 2A-2B illustrate first valve 206 and second valve 216, in some embodiments, wireless flow control device 200 includes one or more intermediary ports, valves, and flow paths that provide fluid flow to turbine 210 and into the flowbore of tubular 116. Further, although FIG. 2A illustrate one opening 204, in some embodiments, shiftable sleeve 202 includes multiple openings configured to form multiple fluid flow paths through wireless flow control device 200. In some embodiment, an adjustable valve is positioned in or around opening 204 to control fluid flow through shiftable sleeve. In the embodiment of FIGS. 2A and 2B, actuation assembly 212 includes a communication module (not shown) that is stored in a housing of the actuation assembly. In some embodiments, the communication module is a remote component.

Figure 3:
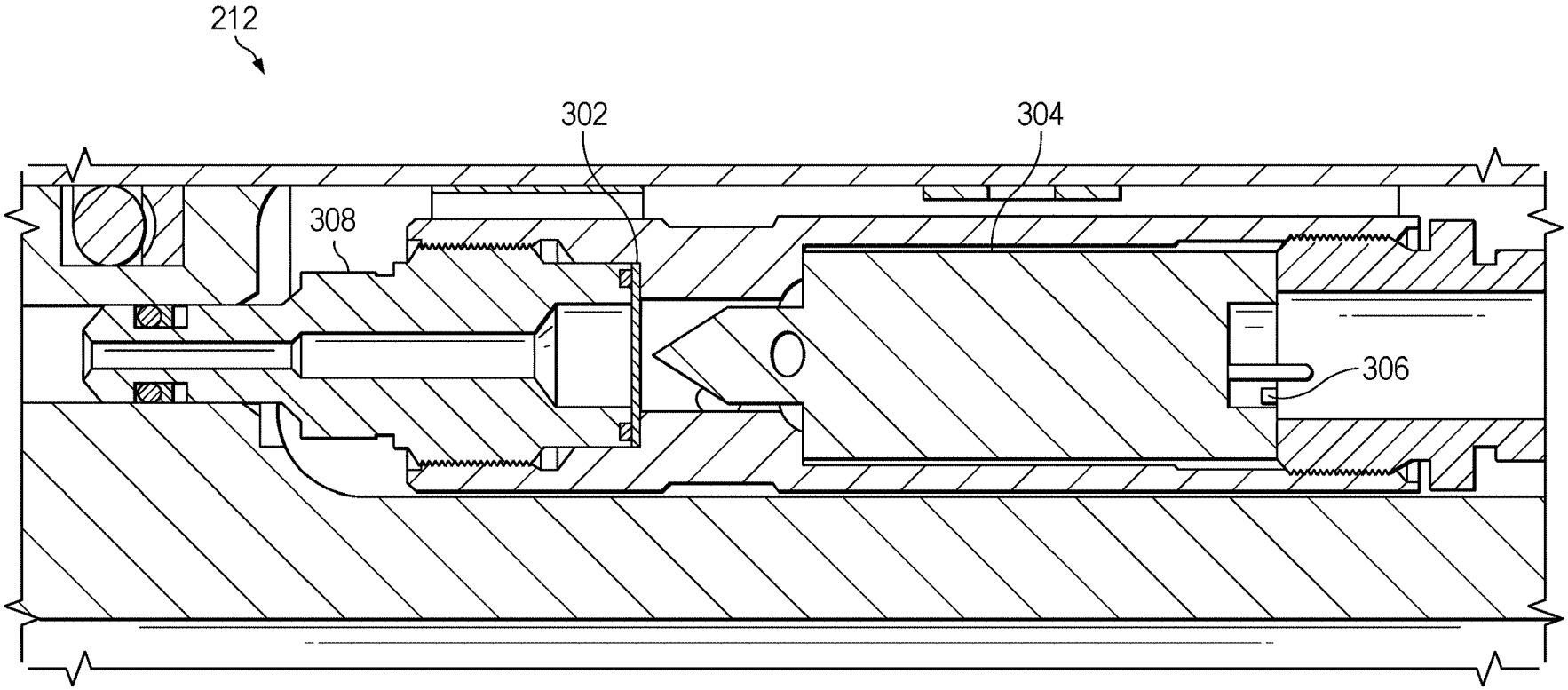
FIG. 3 is a schematic, cross-sectional view of the actuation assembly of wireless flow control device of FIG. 2.

FIG. 3 is a schematic, cross-sectional view of actuation assembly 212 of wireless flow control device 200 of FIG. 2. In the embodiment of FIG. 3, actuation assembly 212 includes a rupture disk 302 that is initially intact to prevent fluid flowing through second valve 216 of FIGS. 2A and 2B to flow through rupture disk 302. Actuation assembly 212 also includes a thruster 304 that is in a first position as illustrated in FIG. 3, and an actuator 306, which, when actuated, shifts thruster 304 from the first position to a second position (not shown) through rupture disk 302 to rupture the rupture disk 302. In some embodiments, actuator 306 is a chemical actuator, which, when actuated, sets off a chemical reaction that shifts thruster 304 from the first position to the second position to rupture the rupture disk 302. In some embodiments, actuator 306 is a chemical actuator, which when actuated, sets off a chemical reaction that pulls a plug 308 out from its sealing location. In some embodiments, actuator 306 is battery operated, and is configured to provide power to shift thruster 304 from the first position to the second position to rupture the rupture disk 302. In some embodiments, actuator 306 is battery operated and is configured to provide power to shift plug 308 from a first sealing position to a second position that allows fluid passage. In the embodiment of FIG. 3, after rupture disk 302 is ruptured, fluid flowing through second valve 216 of FIGS. 2A and 2B also flows through rupture disk 302 to turbine 210 of FIGS. 2A-2C to rotate turbine 210, which recharges power source 214 of FIGS. 2A and 2B to provide power source 214 with sufficient power to shift shiftable sleeve 202 of FIGS. 2A and 2B.

Figure 4:
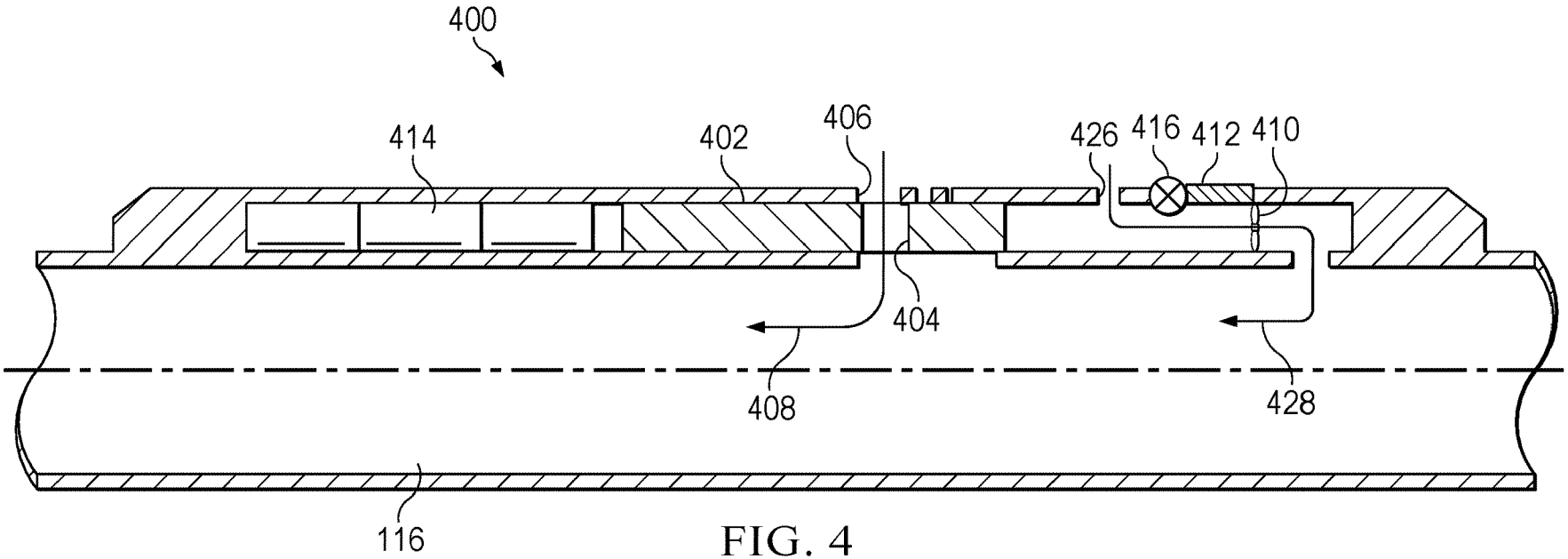
FIG. 4 is a schematic, cross-sectional view of another wireless flow control device that is similar to the wireless flow control device of FIG. 2.

FIG. 4 is a schematic, cross-sectional view of another wireless flow control device 400 that is similar to wireless flow control device 200 of FIG. 2A while a shiftable sleeve 402 of wireless flow control device 400 is in a first position. In the embodiment of FIG. 4, a power source 414 of wireless flow control device 400 provides power to shift shiftable sleeve 402 while power source 414 stores more than a threshold amount of power. In the embodiment of FIG. 4, and while shiftable sleeve 402 is in the first position, a first fluid flow path in a direction illustrated by arrow 408 is established through a first valve 406 of wireless flow control device 400 and an opening 404 of shiftable sleeve 402, and into a flowbore of tubular 116. Further, while shiftable sleeve 402 is in the first position, a second fluid flow path in a direction illustrated by arrow 428 is established through a second valve 426 of wireless flow control device 400 and a housing of wireless flow control device 400 that also houses a turbine 410, and into a flowbore of tubular 116. In that regard, while shiftable sleeve 402 is in the first position, fluids also flow to turbine 410 of wireless flow control device 400 rotates turbine 410, which, in turn, charges power source 414 to maintain the power source above the threshold amount of power. Wireless flow control device 400 also includes an actuation assembly 412 that is similar to actuation assembly 212 of FIG. 2, and a third valve 416. In the embodiment of FIG. 4, actuation assembly 412 initially prevents fluid flow from third valve 416 through wireless flow control device 400 and into the flowbore of tubular 116 before actuation assembly 412 is actuated.

Wireless flow control device 400 periodically receives instructions, such as from controller 118 of FIG. 1, to shift shiftable sleeve 402 to a different position to restrict fluid flow into the flowbore of tubular 116. After shiftable sleeve 402 shifts from the first position illustrated in FIG. 4 to a second position (not shown) that severs the first fluid flow path and the second fluid flow path, fluids no longer flow to turbine 410, and power source 414 is eventually depleted while shiftable sleeve 402 remains in the second position. After power source 414 is depleted, an actuation signal is sent (such as to a communication module of wireless flow control device 400 that is stored in the same housing of power source 414) to actuate actuation assembly 412, and to form a third fluid flow path that is similar to second fluid flow path 218 of FIG. 2B to turbine 410 and eventually into the flowbore of tubular 116. In that regard, although the first fluid flow path and the second fluid flow path are severed by shiftable sleeve 402, fluid flow along the third fluid flow path rotates turbine 410, which, in turn, recharges power source 414 to above a threshold amount of power to shift shiftable sleeve 402. Although FIG. 4 illustrates a shiftable sleeve 402, in some embodiments, wireless flow control device 400 includes another type of shiftable apparatus, such as but not limited to, a shiftable piston, a shiftable cover, a shiftable rod, a concentric sleeve, a piston sleeve, an actuation sleeve, or another type of shiftable apparatus having an opening similar to opening 404.

Figure 5:
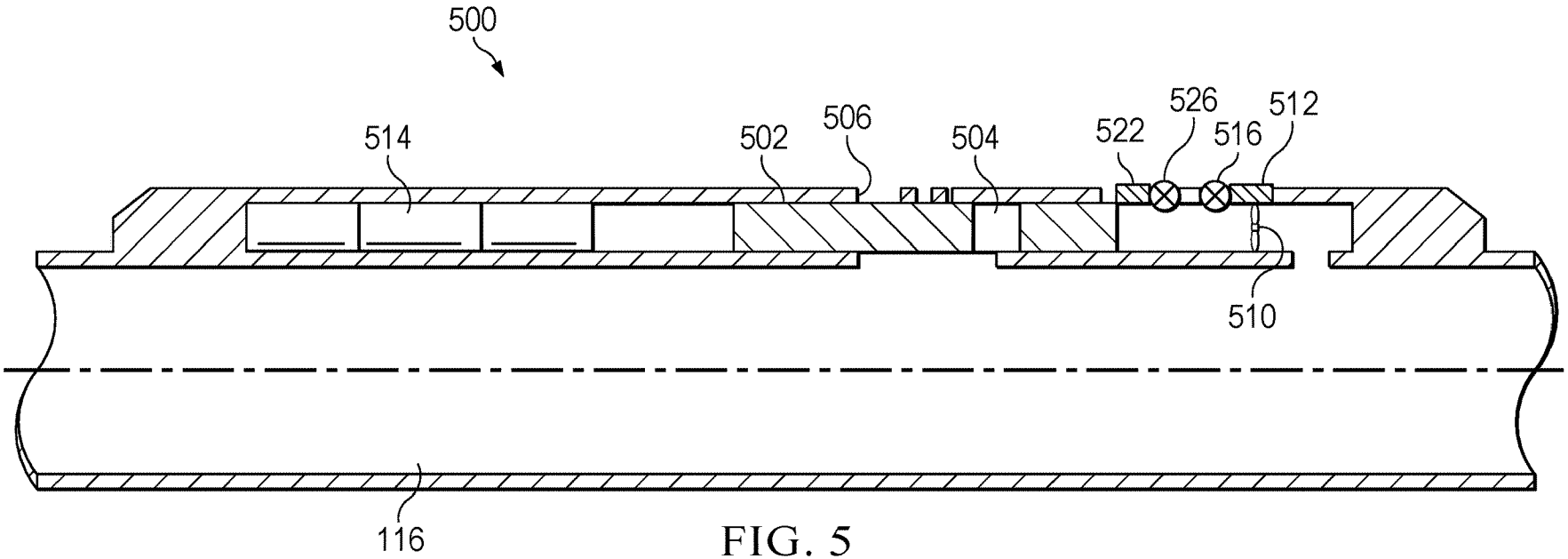
FIG. 5 is a schematic, cross-sectional view of another wireless flow control device that is similar to the wireless flow control device of FIG. 2.

FIG. 5 is a schematic, cross-sectional view of another wireless flow control device 500 that is similar to wireless flow control device 200 of FIG. 2. Wireless flow control device 500 includes a shiftable sleeve 502 that is shiftable from a first position (not shown), where fluid flows through a first fluid flow path formed from a first valve 506 of wireless flow control device 500 and an opening 504 of shiftable sleeve 502 into a flowbore of tubular 116, to a second position illustrated in FIG. 5, where the first fluid flow path through wireless flow control device 500 is severed by shiftable sleeve 502. Wireless flow control device 500 includes a first actuation assembly 522 that is fluidly coupled to a second valve 526 of wireless flow control device 500, and a second actuation assembly 512 that is fluidly coupled a third valve 516 of wireless flow control device 500.

After shiftable sleeve 502 shifts to the second position and a power source 514 of wireless flow control device 500 no longer has sufficient power to shift shiftable sleeve 502, an actuation signal is transmitted (such as from controller 118 of FIG. 1) to a communication module (not shown) of wireless flow control device 500 to establish a second fluid flow path. In the embodiment of FIG. 5, first actuation assembly 522 is similar or identical to actuation assembly 212 of FIG. 3. Moreover, first actuation assembly 522, in response to receiving the actuation signal, sets off a chemical reaction to shift a thruster (not shown) through a rupture disk (not shown) that initially prevents fluids in second valve 526 from flowing through the rupture disk. After the rupture disk is ruptured, fluid flowing through second valve 526 also flows through the rupture disk to a turbine 510 of wireless flow control device 500 to rotate turbine 510, which recharges power source 514 to provide power source 514 with sufficient power to shift shiftable sleeve 502 to the first position to reestablish the first fluid flow path, or eventually to a third position (not shown) to sever the second fluid flow path established by the actuation of first actuation assembly 522. In some embodiments, a command is transmitted by controller 118 of FIG. 1 after completion of a well operation to shift shiftable sleeve 502 to the third position to prevent fluid flow via the first fluid flow path and the second fluid flow path into tubular 116.

After shiftable sleeve 502 shifts to the third position and power source 514 of wireless flow control device 500 no longer has sufficient power to shift shiftable sleeve 502, another actuation signal is transmitted to the communication module of wireless flow control device 500 to establish a third fluid flow path. In the embodiment of FIG. 5, second actuation assembly 512 is also similar or identical to actuation assembly 212 of FIG. 3. Moreover, second actuation assembly 512, in response to receiving the actuation signal, sets off a chemical reaction to shift a thruster (not shown) through a rupture disk (not shown) that initially prevents fluids in third valve 516 from flowing through the rupture disk. After the rupture disk is ruptured, fluid flowing through third valve 516 also flows through the rupture disk to turbine 510, which recharges power source 514 to provide power source 514 with sufficient power to shift shiftable sleeve 502 to the first position to reestablish the first fluid flow path, eventually to a fourth position (not shown) to sever the third fluid flow path, or a different position along wireless flow control device 500. Although FIG. 5 illustrates two actuation assemblies 512 and 522, in some embodiments, wireless flow control device 500 includes three or more actuation assemblies, each configured to establish a fluid path to recharge power source 514. Further, although FIG. 5 illustrates a shiftable sleeve 502, in some embodiments, wireless flow control device 500 includes another type of shiftable apparatus, such as but not limited to, a shiftable piston, a shiftable cover, a shiftable rod, a concentric sleeve, a piston sleeve, an actuation sleeve, or another type of shiftable apparatus having an opening similar to opening 504.

Figure 6:
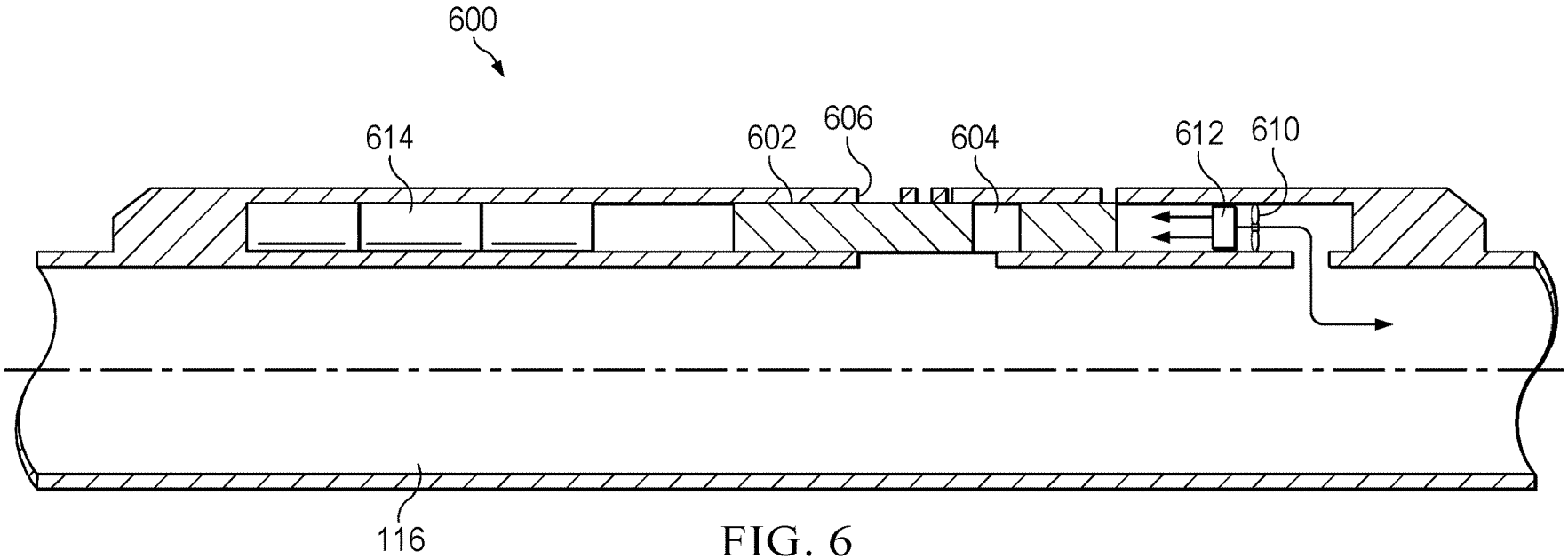
FIG. 6 is a schematic, cross-sectional view of another wireless flow control device that is similar to the wireless flow control device of FIG. 2.

FIG. 6 is a schematic, cross-sectional view of another wireless flow control device 600 that is similar to the wireless flow control device 200 of FIG. 2. In the embodiment of FIG. 6, similar to the embodiment of FIG. 2A, a shiftable sleeve 602 of wireless flow control device 600 is shiftable from a first position (not shown), where fluids flow via a first fluid flow path through valve 606 and an opening 604 of shiftable sleeve 602 into a flowbore of tubular 116, to the second position illustrated in FIG. 6B, where fluid flow through the first fluid flow path is severed by shiftable sleeve 602.

After shiftable sleeve 602 shifts to the second position and a power source 614 of wireless flow control device 600 no longer has sufficient power to shift shiftable sleeve 602, an actuation signal is transmitted (such as from controller 118 of FIG. 1) to a communication module (not shown) of wireless flow control device 600 to reestablish fluid flow through wireless flow control device 600. In the embodiment of FIG. 6, an actuation assembly 612 of wireless flow control device 600, in response to receiving the actuation signal, sets off a chemical reaction to shift shiftable sleeve 602 to the first position or to another position to establish fluid flow to a turbine 610 of wireless flow control device 600 to rotate turbine 610, which recharges power source 614 to provide power source 614 with sufficient power to shift shiftable sleeve 602 for subsequent operations. In some embodiments the chemical reaction shifts shiftable sleeve 602 to the first position to also reestablish fluid flow through the first fluid flow path. In some embodiments, the chemical reaction rotates turbine 610, which recharges power source 614 to provide power source 614 with sufficient power to shift shiftable sleeve 614 for subsequent operations. Although FIG. 6 illustrates a shiftable sleeve 602, in some embodiments, wireless flow control device 600 includes another type of shiftable apparatus, such as but not limited to, a shiftable piston, a shiftable cover, a shiftable rod, a concentric sleeve, a piston sleeve, an actuation sleeve, or another type of shiftable apparatus having an opening similar to opening 604.

Figure 7A:
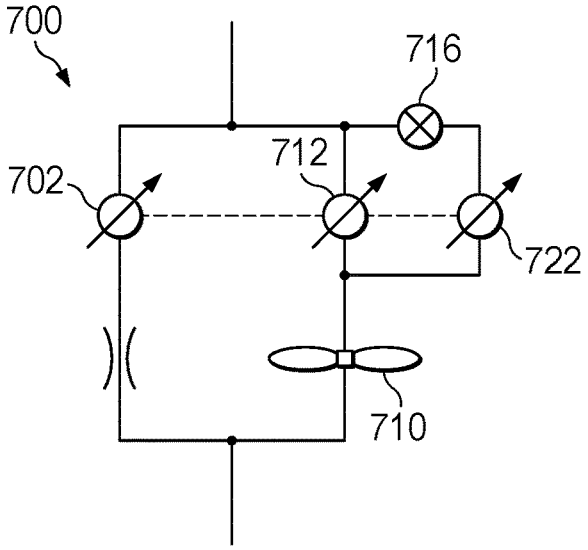
FIG. 7A is a schematic diagram of a first configuration of a wireless flow control device that is similar to the wireless flow control device of FIG. 2A.

FIG. 7A is a schematic diagram 700 of a first configuration of a wireless flow control device that is similar to wireless flow control device 200 of FIG. 2A. In the embodiment of FIG. 7A, adjustable valves 702, 712, and 722 are components of a shiftable apparatus (e.g., openings of shiftable sleeve) of the wireless flow control device and are coupled to each other. Further, the wireless flow control device also includes a valve 716 that is actuated by an actuation assembly such as actuation assembly 212 of FIG. 2A to provide fluid flow to a turbine 710 of the wireless flow control device. Further, the shiftable apparatus is configured to shift to different positions to fluidly couple one or more of adjustable valves 702, 704, and 706 with valve 716 or other valves (not shown), ports (not shown) or openings (not shown) to provide fluid flow through the wireless flow control device, and to provide fluid flow to turbine 710.

Figure 7B:
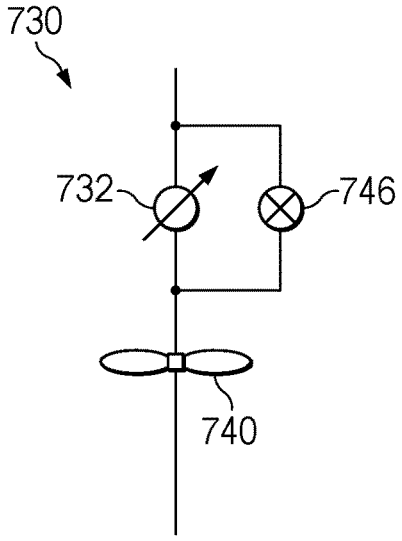
FIG. 7B is a schematic diagram of a second configuration of a wireless flow control device that is similar to the wireless flow control device of FIG. 2A.

FIG. 7B is schematic diagram 730 of a second configuration of a wireless flow control device that is similar to wireless flow control device 200 of FIG. 2A. In the embodiment of FIG. 7B, an adjustable valve 732 of a shiftable apparatus of the wireless flow control device is in series with a turbine 740 of the wireless flow control device. Further, the wireless flow control device also includes a valve 746 that is actuated by an actuation assembly such as actuation assembly 212 of FIG. 2A to provide fluid flow to turbine 740. In the embodiment of FIG. 7B, adjustable valve 732 is parallel to valve 746.

Figure 7C:
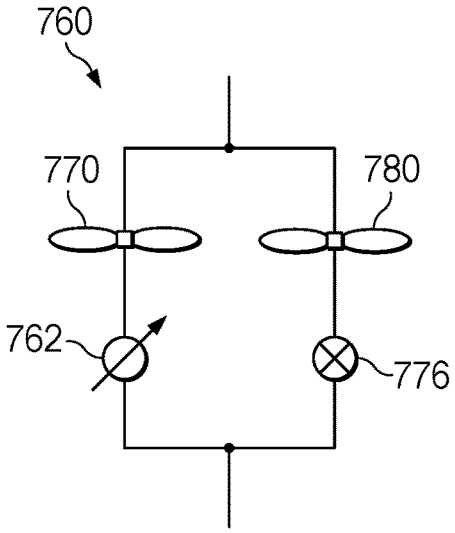
FIG. 7C is a schematic diagram of a third configuration of a wireless flow control device that is similar to the wireless flow control device of FIG. 2A.

FIG. 7C is schematic diagram 760 of a third configuration of a wireless flow control device that is similar to wireless flow control device 200 of FIG. 2A. In the embodiment of FIG. 7C, an adjustable valve 762 of a shiftable apparatus of the wireless flow control device is in series with a first turbine 770 of the wireless flow control device. Further, the wireless flow control device also includes a valve 776 that is actuated by an actuation assembly such as actuation assembly 212 of FIG. 2A to provide fluid flow to a second turbine 780 of the wireless flow control device. In the embodiment of FIG. 7C, adjustable valve 762 and first turbine 770 are in series with each other, whereas valve 776 and second turbine 780 are in series with each other. Further, adjustable valve 762 and first turbine 770 are parallel to valve 776 and second turbine 780. More particularly, in the embodiment of FIG. 7C, parallel (or different) fluid flow paths are established to rotate first turbine 770 and second turbine 780.

Figure 8:
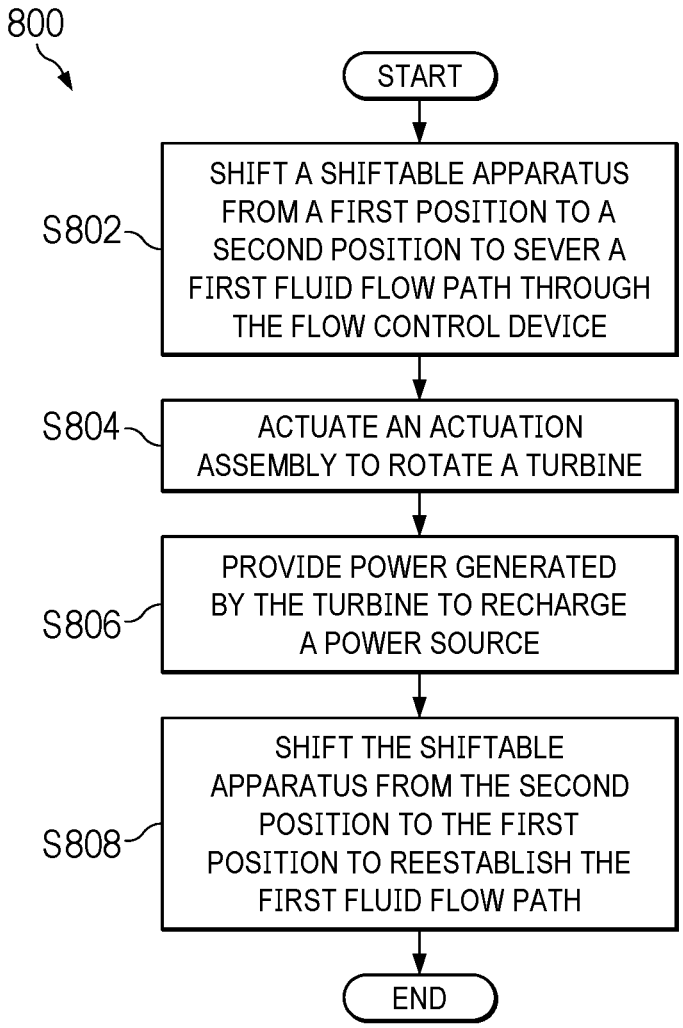
FIG. 8 is a flow chart of a process to reestablish fluid flow through a flow control device.

FIG. 8 is a flow chart of a process 800 to reestablish fluid flow through a flow control device. Although the operations in the process 800 are shown in a particular sequence, certain operations may be performed in different sequences or at the same time where feasible.

At block S802, a shiftable apparatus is shifted from a first position to a second position to sever a first fluid flow path through a flow control device. In that regard, FIGS. 2A-2B, illustrate shifting shiftable apparatus 202 from the first position illustrated in FIG. 2A to the second position illustrated in FIG. 2B to sever the first fluid flow path illustrated by arrow 208. At block S804, an actuation assembly is actuated to rotate a turbine. In that regard, FIG. 3 illustrates an actuation assembly 212 containing a rupture disk 302, a thruster 304, and an actuator 306, which, when actuated, shifts thruster 304 from the first position illustrated in FIG. 3 to a second position (not shown) through rupture disk 302 to rupture the rupture disk 302. In some embodiments, actuator 306 is a chemical actuator, which, when actuated, sets off a chemical reaction that shifts thruster 304 from the first position to the second position to rupture the rupture disk 302. In some embodiments, actuator 306 is battery operated, and is configured to provide power to shift thruster 304 from the first position to the second position to rupture the rupture disk 302. After rupture disk 302 is ruptured, fluid flowing through rupture disk 302 also flows to turbine 210 of FIGS. 2A-2C to rotate turbine 210. In some embodiments, a second fluid flow path through the wireless flow control device, such as the second fluid flow path of FIG. 2B as indicated by arrow 218 of FIG. 2B, is established after actuation of the actuation assembly. In the embodiment of FIG. 2B, fluid flowing through the second fluid flow path rotates turbine 210 and eventually flows into the flowbore of tubular 116 of FIG. 2B.

At block S806, power generated by the turbine is provided to a power source to recharge the power source. Turbine 210 of FIGS. 2A-2C, for example, recharges power source 214 of FIGS. 2A and 2B to provide power source 214 with sufficient power to shift shiftable sleeve 202 of FIGS. 2A and 2B. At block S808, the shiftable apparatus is shifted from the second position to the first position to reestablish the first fluid flow path. In that regard, after power source 214 is sufficiently charged, power source 214 provides power to shift shiftable sleeve 214 from the second position illustrated in FIG. 2B back to the first position illustrated in FIG. 2A to reestablish the first fluid path. In some embodiments, after the shiftable apparatus is shifted to the first position, and after completion of an operation, the shiftable apparatus is subsequently shifted to a third position, such as the position illustrated in FIG. 2C to sever both the first and the second fluid flow paths through the wireless flow control device. In some embodiments, where the wireless flow control device includes additional actuation assemblies, an additional assembly is actuated after the shiftable apparatus is in the third position to reestablish fluid flow to the turbine, which recharges the power source of the wireless flow control device to shift the shiftable apparatus from the third position to a different position.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a wireless flow control device, comprising: a shiftable apparatus; a power source configured to provide power to shift the shiftable apparatus from a first position to a second position; a valve that forms a first fluid flow path through the wireless flow control device while the shiftable apparatus is in the first position; an actuation assembly, which, when actuated, forms a second fluid flow path through the wireless flow control device; and a turbine configured to recharge the power source.

Clause 2, the wireless flow control device of clause 1, further comprising a second valve that is fluidly coupled to the actuation assembly, wherein the second valve and the actuation assembly form the second fluid flow path after the actuation assembly is actuated, and wherein the turbine is positioned along the second fluid flow path and configured to recharge the power source while fluid flowing through the second fluid flow path rotates the turbine.

Clause 3, the wireless flow control device of clause 2, wherein the power source is configured to provide power to shift the shiftable apparatus from the second position to the first position to reestablish the first fluid flow path through the wireless flow control device after the fluid flowing through the second fluid flow path rotates the turbine.

Clause 4, the wireless flow control device of any of clauses 1-3, further comprising a second turbine positioned along the second fluid flow path and configured to recharge the power source while fluid flowing through the second fluid flow path rotates the second turbine, wherein the turbine is positioned along the first fluid flow path and is configured to recharge the power source while fluid is flowing through the first fluid flow path rotates the turbine.

Clause 5, the wireless flow control device of any of clauses 1-4, wherein the actuation assembly comprises: a rupture disk; and a thruster configured to shift from a first position to a second position to rupture the rupture disk, wherein the actuation assembly is actuated after the thruster shifts from the first position to the second position.

Clause 6, the wireless flow control device of clause 5, wherein the thruster comprises a chemical actuator configured to: receive an actuation signal; and in response to receiving the actuation signal, initiate a chemical reaction that shifts the thruster from the first position to the second position.

Clause 7, the wireless flow control device of any of clauses 1-6, wherein the shiftable apparatus comprises an opening that is fluidly coupled to the valve to form the first fluid flow path with the valve while the shiftable apparatus is in the first position.

Clause 8, the wireless flow control device of any of clauses 1-7, wherein the shiftable apparatus is configured to shift to a third position, wherein the first fluid flow path and the second fluid flow path are severed while the shiftable apparatus is in the third position.

Clause 9, the wireless flow control device of any of clauses 1-8, wherein the power source is configured to provide power to a communication module, and wherein the communication module is configured to receive an actuation signal to actuate the actuation assembly.

Clause 10, the wireless flow control device of any of clauses 1-9, further comprising a second actuation assembly, which, when actuated, forms a third fluid flow path through the wireless flow control device.

Clause 11, a wireless flow control device, comprising: a shiftable apparatus; a power source configured to provide power to shift the shiftable apparatus from a first position to a second position; a valve that forms a first fluid flow path through the wireless flow control device while the shiftable apparatus is in the first position; a turbine configured to recharge the power source; and an actuator configured to actuate after the shiftable apparatus is shifted from the first position to the second position, wherein, actuation of the actuation assembly causes the shiftable apparatus to shift from the second position to the first position.

Clause 12, the wireless flow control device of clause 11, wherein the actuator comprises a chemical charge, which, when actuated, shifts the shiftable apparatus from the second position to the first position.

Clause 13, the wireless flow control device of clauses 11 or 12, wherein the actuator comprises a chemical charge, which, when actuated, rotates the turbine.

Clause 14, the wireless flow control device of any of clauses 11-13, further comprising an actuation assembly, which, when actuated, forms a second fluid flow path through the wireless flow control device, wherein the actuator is a component of the actuation assembly, and wherein the turbine is positioned along the second fluid flow path and configured to recharge the power source while fluid flowing through the second fluid flow path rotates the turbine.

Clause 15 the wireless flow control device of clause 14, wherein the power source is configured to provide power to shift the shiftable apparatus from the second position to the first position to reestablish the first fluid flow path through the wireless flow control device after the fluid flowing through the second fluid flow path rotates the turbine.

Clause 16, a method to reestablish fluid flow through a wireless flow control device, comprising: shifting a shiftable apparatus from a first position to a second position to sever a first fluid flow path through the wireless flow control device; after the first fluid flow path through the flow control device is severed, actuating an actuation assembly to rotate a turbine; providing power generated by the turbine to recharge a power source; and after the power source is recharged, shifting the shiftable apparatus from the second position to the first position to reestablish the first fluid flow path.

Clause 17, the method of clause 16, wherein actuating the actuation assembly further comprises actuating the actuation assembly to establish a second fluid flow path through the wireless flow control device, wherein fluid flowing through the second fluid flow path rotates the turbine.

Clause 18, the method of clause 17, further comprising shifting the shiftable apparatus from the second position to a third position to sever the second fluid flow path.

Clause 19, the method of clause 18, further comprising: after fluid flow through the second fluid flow control device is severed, actuating a second actuation assembly to rotate the turbine; providing power generated by the turbine to recharge the power source; after the power source is recharged, shifting the shiftable apparatus from the third position to the first position to reestablish the first fluid flow path.

Clause 20, the method of any of clauses 16-19, wherein the actuation assembly comprises a rupture disk and a thruster, and wherein actuating the actuation assembly comprises: initiating a chemical reaction to shift the thruster from a first position to a second position to puncture the rupture disk; and establishing the second fluid flow path through the rupture disk after the rupture disk is punctured.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Arrows indicating directions of fluid flow are illustrated for illustration purposes only. It is understood that fluids may flow in additional directions not shown in the Figures.

What is claimed is:

1. A wireless flow control device, comprising:

a shiftable apparatus;

a power source configured to provide power to shift the shiftable apparatus from a first position to a second position, and from a second position to a third position;

a valve that forms a first fluid flow path through the wireless flow control device while the shiftable apparatus is in the first position;

an actuation assembly, which, when actuated, forms a second fluid flow path through the wireless flow control device;

a second actuation assembly, which is actuated after the shiftable apparatus shifts from the second position to the third position, and which, when actuated, forms a third fluid flow path through the wireless flow control device; and a turbine configured to recharge the power source.

2. The wireless flow control device of claim 1, further comprising a second valve that is fluidly coupled to the actuation assembly, wherein the second valve and the actuation assembly form the second fluid flow path after the actuation assembly is actuated, and wherein the turbine is positioned along the second fluid flow path and configured to recharge the power source while fluid flowing through the second fluid flow path rotates the turbine.

3. The wireless flow control device of claim 2, wherein the power source is configured to provide power to shift the shiftable apparatus from the second position to the first position to reestablish the first fluid flow path through the wireless flow control device after the fluid flowing through the second fluid flow path rotates the turbine.

4. The wireless flow control device of claim 1, further comprising a second turbine positioned along the second fluid flow path and configured to recharge the power source while fluid flowing through the second fluid flow path rotates the second turbine, wherein the turbine is positioned along the first fluid flow path and is configured to recharge the power source while fluid is flowing through the first fluid flow path rotates the turbine.

5. The wireless flow control device of claim 1, wherein the actuation assembly comprises:

a rupture disk; and a thruster configured to shift from a first position to a second position to rupture the rupture disk, wherein the actuation assembly is actuated after the thruster shifts from the first position to the second position.

6. The wireless flow control device of claim 5, wherein the thruster comprises a chemical actuator configured to:

receive an actuation signal; and in response to receiving the actuation signal, initiate a chemical reaction that shifts the thruster from the first position to the second position.

7. The wireless flow control device of claim 1, wherein the shiftable apparatus comprises an opening that is fluidly coupled to the valve to form the first fluid flow path with the valve while the shiftable apparatus is in the first position.

8. The wireless flow control device of claim 1, wherein the shiftable apparatus is configured to shift to a third position, wherein the first fluid flow path and the second fluid flow path are severed while the shiftable apparatus is in the third position.

9. The wireless flow control device of claim 1, wherein the power source is configured to provide power to a communication module, and wherein the communication module is configured to receive an actuation signal to actuate the actuation assembly.

10. A wireless flow control device, comprising:

a shiftable apparatus;

a power source configured to provide power to shift the shiftable apparatus from a first position to a second position, and from a second position to a third position;

a valve that forms a first fluid flow path through the wireless flow control device while the shiftable apparatus is in the first position;

an actuation assembly, which is actuated after the shiftable apparatus shifts from the second position to the third position, and which, when actuated, forms a second fluid flow path through the wireless flow control device;

a second actuation assembly, which, when actuated, forms a third fluid flow path through the wireless flow control device;

and an actuator configured to actuate after the shiftable apparatus is shifted from the first position to the second position, wherein, actuation of the actuation assembly causes the shiftable apparatus to shift from the second position to the first position.

11. The wireless flow control device of claim 10, wherein the actuator comprises a chemical charge, which, when actuated, shifts the shiftable apparatus from the second position to the first position.

12. The wireless flow control device of claim 10, wherein the actuator comprises a chemical charge, which, when actuated, rotates a turbine.

13. The wireless flow control device of claim 10, wherein the actuator is a component of the actuation assembly, and wherein the wireless flow control device further comprises a turbine that is positioned along the second fluid flow path and configured to recharge the power source while fluid flowing through the second fluid flow path rotates the turbine.

14. The wireless flow control device of claim 13, wherein the power source is configured to provide power to shift the shiftable apparatus from the second position to the first position to reestablish the first fluid flow path through the wireless flow control device after the fluid flowing through the second fluid flow path rotates the turbine.

15. A method to reestablish fluid flow through a wireless flow control device, comprising:

shifting a shiftable apparatus from a first position to a second position to sever a first fluid flow path through the wireless flow control device;

after the first fluid flow path through the flow control device is severed, actuating an actuation assembly to rotate a turbine;

providing power generated by the turbine to recharge a power source;

after the power source is recharged, shifting the shiftable apparatus from the second position to the first position to reestablish the first fluid flow path;

actuating the actuation assembly to establish a second fluid flow path through the wireless flow control device;

shifting the shiftable apparatus from the second position to a third position to sever the second fluid flow path; and after fluid flow through the second fluid flow control device is severed, actuating a second actuation assembly to rotate the turbine.

16. The method of claim 15, wherein fluid flowing through the second fluid flow path rotates the turbine.

17. The method of claim 15, further comprising:

providing power generated by the turbine to recharge the power source; and after the power source is recharged, shifting the shiftable apparatus from the third position to the first position to reestablish the first fluid flow path.

18. The method of claim 15, wherein the actuation assembly comprises a rupture disk and a thruster, and wherein actuating the actuation assembly comprises:

initiating a chemical reaction to shift the thruster from a first position to a second position to puncture the rupture disk; and establishing the second fluid flow path through the rupture disk after the rupture disk is punctured.

* * * * *